US005311645A

United States Patent [19]

Schwalm et al.

[11] Patent Number: 5,311,645

[45] Date of Patent: May 17, 1994

[54] CAN DISTRIBUTION APPARATUS

[75] Inventors: Hans-Werner Schwalm; Rolf Schumacher; Reiner Reising, all of Monchen-Gladbach, Fed. Rep. of Germany

[73] Assignee: W. Schlafhorst AG & Co., Monchen-Gladbach, Fed. Rep. of Germany

[21] Appl. No.: 945,026

[22] Filed: Sep. 14, 1992

[30] Foreign Application Priority Data

Sep. 13, 1991 [DE] Fed. Rep. of Germany ..... 4130463

[51] Int. Cl.[5] ..... D04H 11/00; D01H 13/02

[52] U.S. Cl. ..... 19/159 A; 57/90

[58] Field of Search ..... 19/159 A, 159 R; 57/90, 57/279, 280; 198/346.1, 346.2; 209/522, 523; 414/223; 15/312.1

[56] References Cited

U.S. PATENT DOCUMENTS

| | | | |
|---|---|---|---|
| 4,070,731 | 1/1978 | Roberson | 19/159 A |
| 4,208,762 | 6/1980 | Starling | 15/312.1 |
| 4,380,842 | 4/1983 | Thomas | 15/312.1 X |
| 4,697,310 | 10/1987 | Raasch | 19/159 A |
| 4,932,201 | 6/1990 | Meroni et al. | 57/90 X |
| 4,977,738 | 12/1990 | Stahlecker | 57/90 X |
| 4,987,649 | 1/1991 | Meyer et al. | 19/159 A X |
| 5,086,616 | 2/1992 | Gümkinger | 19/159 A X |
| 5,138,558 | 8/1992 | Meyer et al. | 19/189 A X |

FOREIGN PATENT DOCUMENTS

| | | | |
|---|---|---|---|
| 3809282 | 9/1989 | Fed. Rep. of Germany | 19/159 A |
| 2028416 | 2/1987 | Japan | 19/159 A |

*Primary Examiner*—Clifford D. Crowder
*Assistant Examiner*—John J. Calvert
*Attorney, Agent, or Firm*—Shefte, Pinckney & Sawyer

[57] ABSTRACT

A can distribution apparatus includes an assembly forming an endless path interconnecting a plurality of distribution locations for support movement of cans to and between distribution locations and an assembly for simultaneously advancing cans of varying degrees of fullness and readiness to a textile machine. The can distribution locations include a textile machine delivery location, a can return location, a full can supply location, and a can receipt location. The advancement of each can is effected simultaneous with the advancement of the other cans in the endless path independent of whether the can is empty, partially loaded or contains a full load and whether the full load is prepared for delivery or not. A detector detects the sliver fullness of each can on the endless path and signals this information to a control device which controls the distribution of cans to the various can distribution locations. A sliver end preparation device prepares full cans for delivery to a textile machine and a detector detects the presence or absence of an end in a preferred position. The control device prevents the distribution of cans having a full load of unprepared sliver to a textile machine in response to a signal from the detector.

16 Claims, 9 Drawing Sheets

CAN DISTRIBUTION APPARATUS

BACKGROUND OF THE INVENTION

The invention relates to a can distribution apparatus between at least one textile machine, which is to be supplied with filled cans and from which empty cans are to be removed and which processes sliver, and a line or temporary can store that receives empty cans and discharges filled cans, having a station for transferring empty cans from a can transport means to the can distribution apparatus and for transferring full cans to the can transport means, and having a station for discharging empty cans and delivering full cans.

German Offenlegungsschrift DE 38 05 203 A discloses a sliver can distribution assembly in which empty cans are reloaded with sliver and disposed on an endless path for travel to locations at which the full cans are transferred to movable carts for subsequent movement to a spinning machine. The movable carts also dispose empty cans on the endless path for movement to the sliver reloading device to receive fresh loads of sliver.

British Patent Specification 910,761 discloses an apparatus for transporting sliver containers between a sliver coiling station in which sliver is coiled into the containers and a draw frame at which sliver is drawn from the sliver containers. An endless path extends between the coiling machine and the draw frame for movement of the sliver containers with full loads of sliver from the coiling device to the draw frame and for movement of empty sliver containers from the draw frame to the coiling device. While these known sliver can transport arrangements are operable to simultaneously transport empty and full sliver containers between a device for reloading sliver into the containers and a location at which containers with a full load of sliver are positioned adjacent a textile machine such as a draw frame or a spinning machine, none of these prior art arrangements provide the capability to transport cans having a full load of sliver but not in a desired readiness condition for transfer to a textile machine for automatic engagement of the sliver in the can. While other prior art arrangements have been proposed for transporting such cans to a textile machine, there is still room for improvement in a sliver can distribution apparatus which efficiently transports cans in various degrees of sliver fullness and in varying degrees of readiness for delivery to a textile machine.

SUMMARY OF THE INVENTION

The present invention provides a sliver can distribution apparatus for distributing cans of the type which carry a load of sliver including means forming an endless path interconnecting a plurality of can distribution locations for supported movement of cans to and between the can distribution locations and means for simultaneously advancing along the endless path cans of varying degrees of sliver fullness and readiness for delivery. The can distribution locations include a textile machine delivery location at which cans having a full load of sliver prepared for automatic engagement of the sliver by a textile machine are distributed from the endless path to a textile machine can delivery device, a can return location at which cans are returned to the endless path from the textile machine can delivery device, a full can supply location at which cans with full loads of sliver are supplied to the endless path, and a can receipt location at which cans having less than a full load of sliver are received from the endless path for subsequent filling of the cans with sliver.

The means for simultaneously advancing along the endless path cans of varying degrees of sliver fullness and varying degrees of readiness for delivery to a textile machine advances each can simultaneous with the advancement of the other cans in the endless path independent of whether the can is an empty can, a can having a partial load of sliver, a can having a full load of sliver but not prepared for delivery to a textile machine, or a can having a full load of sliver and prepared for delivery to a textile machine.

Preferably, the sliver can distributing apparatus also includes means associated with at least one of the can distribution locations for selectively transferring only those cans suitable for distribution to the at least one can distribution location. According to one aspect of the present invention, the selectively transferring means includes means for transferring only cans having a full load of sliver and in condition for delivery to a textile machine from the endless path to the textile can delivery location.

According to another aspect of the present invention, the selectively transferring means includes means for transferring only empty cans from the endless path to the can return location.

In one feature of the present invention, the selectively transferring means includes means for transferring only empty cans from the endless path to the can return location. In another feature of the present invention, the distinguishing means includes means for determining whether a can in the endless path has less than a predetermined amount of sliver therein, the selectively transferring means being operable to transfer those cans having less than a predetermined amount of sliver from the endless path to the can return location in response to a determination by the delivery means that the can has less than the predetermined amount of sliver.

According to a further aspect of the present invention, the sliver can distribution apparatus includes means for determining the location of those cans which have been distinguished by the distinguishing means on the endless path and means for transferring cans in correspondence with the positioning of such cans at the at least one can distribution location. Additionally, the apparatus includes means operatively connected to the location determining means for informing an operator about the sliver fullness or readiness condition of cans on the endless path.

In an additional feature of the further aspect of the present invention, the simultaneously advancing means includes a plurality of can support positions which are simultaneously advanced along the endless path, each can support position for supporting a can, and means for identifying the unoccupied can support positions on the endless path, the distinguishing means includes means for determining the sliver fullness of cans on the endless path and means for ascertaining the readiness of cans on the endless path for transfer at the spinning machine delivery location and the operator informing means is operatively connected to the sliver fullness determining means, the readiness ascertaining means, the location determining means and the unoccupied can support position identifying means for informing an operator about the sliver fullness and readiness status of cans on the endless path. Preferably, the sliver can distributing apparatus also includes can reload means operatively connected to the can receipt location for reloading cans received thereat with loads of sliver and operatively connected to the full can supply location for supplying reloaded cans having full loads of sliver to the endless path and means for controlling the supply of reloaded cans to the endless path such that, if the can support positions of the endless path are fully occupied, a reloaded can is only supplied to the endless path at the full can supply location if a can to be reloaded has been received from the endless path at the can receipt location.

According to an additional further aspect of the present invention, there is provided means operatively connected to the sliver fullness determining means and the readiness ascertaining means for counting the number of cans having less than a full load of sliver and the number of cans not prepared for distribution at the textile machine delivery location and means operatively connected to the counting means for signaling that a predetermined limit number of cans without a full load and non-prepared cans has been reached.

In yet another aspect of the present invention, each can has a movable bottom which moves upwardly as sliver is drawn from the can, and the sliver fullness determining means includes means for detecting the height of the bottom of a can.

According to yet an additional feature of the present invention, there is also provided means for positioning an end of sliver in a predetermined position relative to the can in which the sliver is coiled for automatic engagement of the positioned sliver end at a spinning machine and the distinguishing means includes means for ascertaining the readiness of a can for distribution at the textile machine delivery location based upon detection of the presence or absence of a sliver end in the predetermined position.

According to yet a further additional feature of the present invention, the simultaneously advancing means includes means for incrementally moving the cans by a uniform distance increment at least as great as the width of a can in a cyclical manner in which the time between each cycle of incremental movement is set at the respective longest time for handling of a can at the can distribution locations.

DETAILED DESCRIPTION OF THE PREFERRED EMBODIMENT

Figure 1:
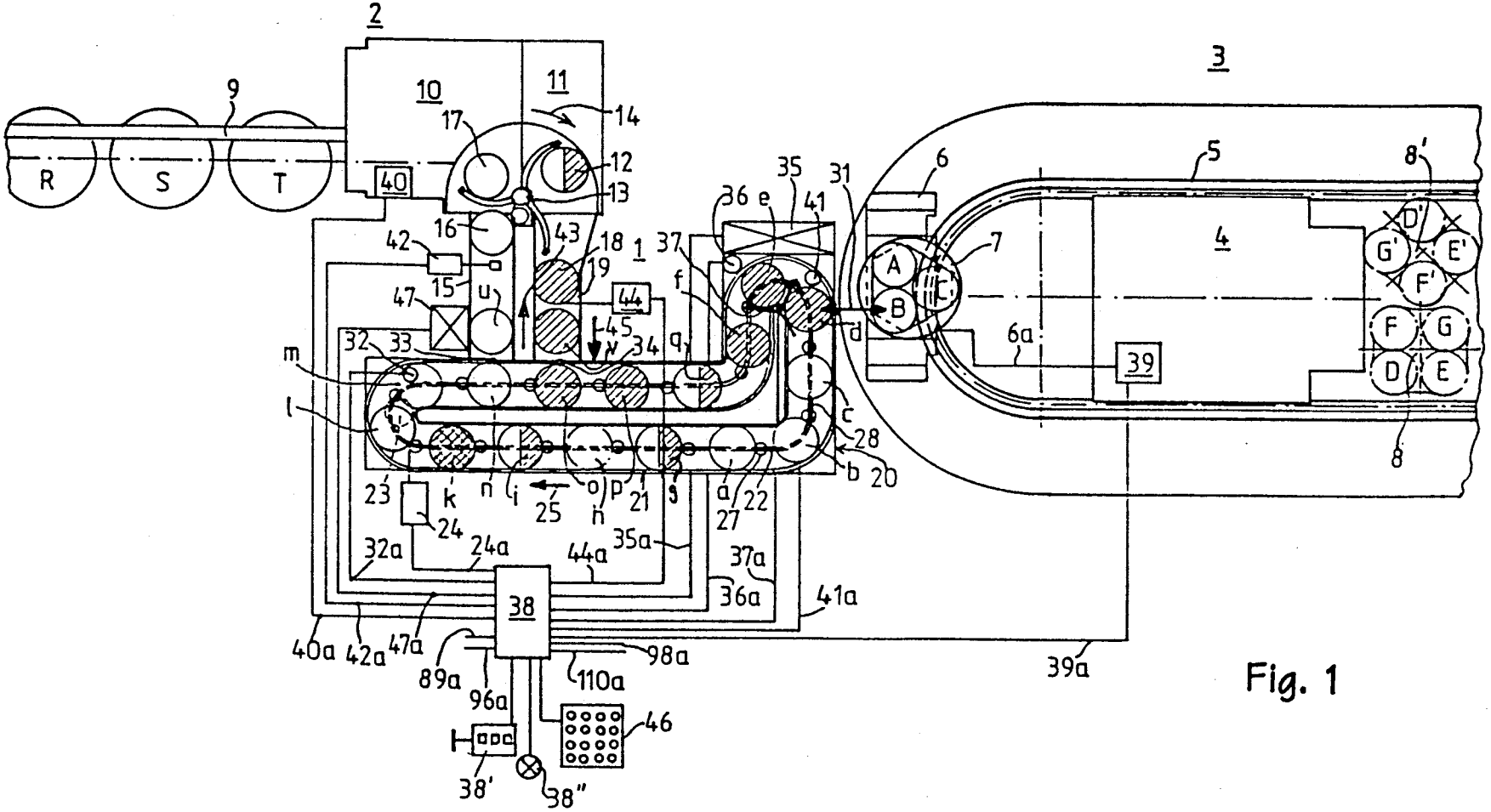
FIG. 1 is a schematic top plan view of the preferred embodiment of the sliver can distribution apparatus of the present invention, showing the distribution apparatus in its operative position in association with a can reloading device and a textile machine.

As seen in FIG. 1, a can distribution apparatus 1 extends between a sliver loading assembly 2 and a spinning machine 3 for distributing cans of the type in which sliver is coiled to the filling station 2 and the spinning machine 3. This spinning machine is an open-end spinning machine for spinning rotor yarns, as is known from the prior art. The spinning machine 3 which is only schematically illustrated, includes a drive unit 4 and rails 5 extending around the top end of the machine for guiding a can carriage 6, which is in the form of a can transport carriage with a turntable 7 with can support positions A, B and C for sliver cans. The can carriage 6 can move along the spinning machine 3 on both sides thereof, guided by the rails 5 and delivers to the various spinning stations filled sliver cans while, at the same time, retrieving the empty cans therefrom. There are another four cans D, E, F and G on turntables 8 below the spinning stations; four spinning stations located next to one another are supplied with sliver from these cans. The turntable 8' located on the opposite side of the spinning machine is rotatable through 45° increments so that the sliver can at position D', which has become empty, can be replaced by the can carriage 6.

Along the sliver loading assembly 2, sliver is drawn from large cans R, S and T. Sliver enters the drawing mechanisms 10 via a sliver delivery means 9, not shown in detail here, and from there enters a can reload means for reloading cans with full loads of sliver in the form of a can filling station 11, which is symbolized by a can 12 that is half-filled, as indicated by the shading. The cans are passed through the can filling station by means of a turnstile 13. The turnstile 13 rotates in the clockwise direction 14 and with its arms receives the empty cans, which are located on a empty can advancing device 15 for delivering the empty cans to the waiting position 16, and delivers them via a readiness position 17 to the filling station 11. In the incremental rotation of the turnstile 13, a filled can 18 is pushed out of the can filling station 11 onto a can advancing device 19, with which the full cans are delivered to the can distribution apparatus 1.

The can distribution apparatus 1 has a closed loop transport assembly 20 forming an endless path, which provides a circulation of the cans within a closed loop past the various stations. The closed loop transport assembly comprises a guide track 21 for supporting the cans and a means for simultaneously advancing along the endless path cans of varying degrees of sliver fullness and varying degrees of readiness for delivery to the spinning machine in the form of a revolving endless chain 22. The chain 22 may, for instance, be a link chain, which is driven via a gear 23 by means of a motor 24. The chain links stand vertically and the chain 22 moves clockwise in the direction of the arrow 25 at a specified rate. The endless chain 22 is preferably incrementally movable by a uniform distance increment at least as great as the width of a can in a cyclical manner in which the time between each cycle of incremental movement is set at the respective longest time for handling of a can at the can distribution locations.

Figure 2:
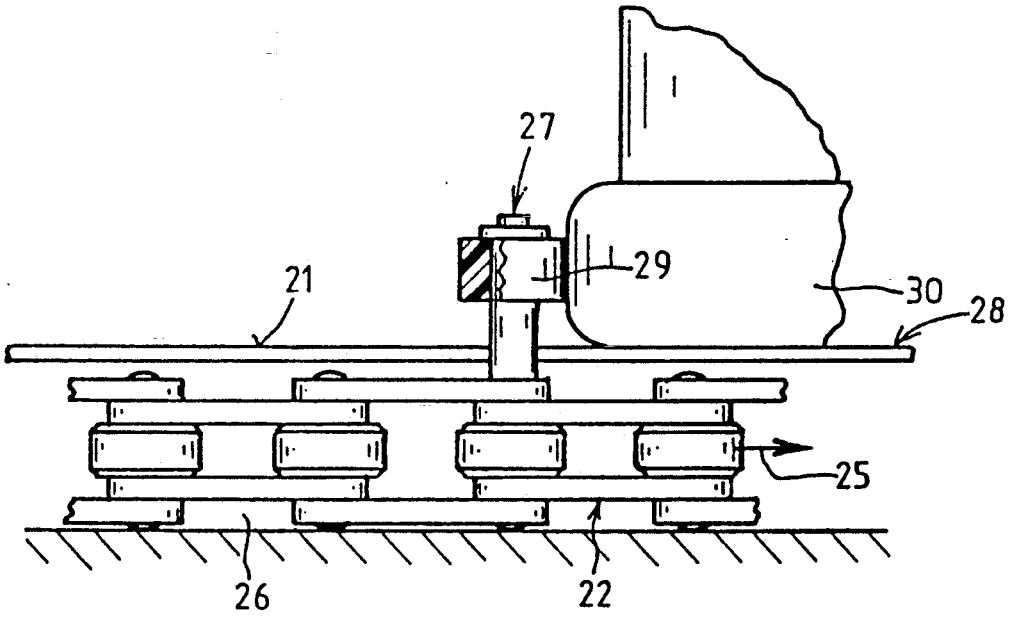
FIG. 2 is an enlarged front elevational view, in partial vertical section, of a portion of the simultaneously advancing means of the sliver can distribution apparatus shown in FIG. 1.

FIG. 2 shows the structure of the closed loop transport assembly 20. The link chain 22 runs in a guide groove 26 below the guide track 21. At predetermined intervals adapted to the can diameter, vertical pins of the chain in the form of drivers 27 protrude out of the guide groove 26 vertically through a guide slit 28. At the top, these drivers 27 may have a roller 29 by which they rest on the lower edge 30 of a can to be transported. Each driver 27 presses with its roller 29 against the outer edge of the can and pushes it ahead of the driver in the transport direction 25. It is also conceivable, however, for the drivers to press against the edge of the can from the inside, and thus carry the cans with them as they travel through the can distribution apparatus.

Figure 3A:
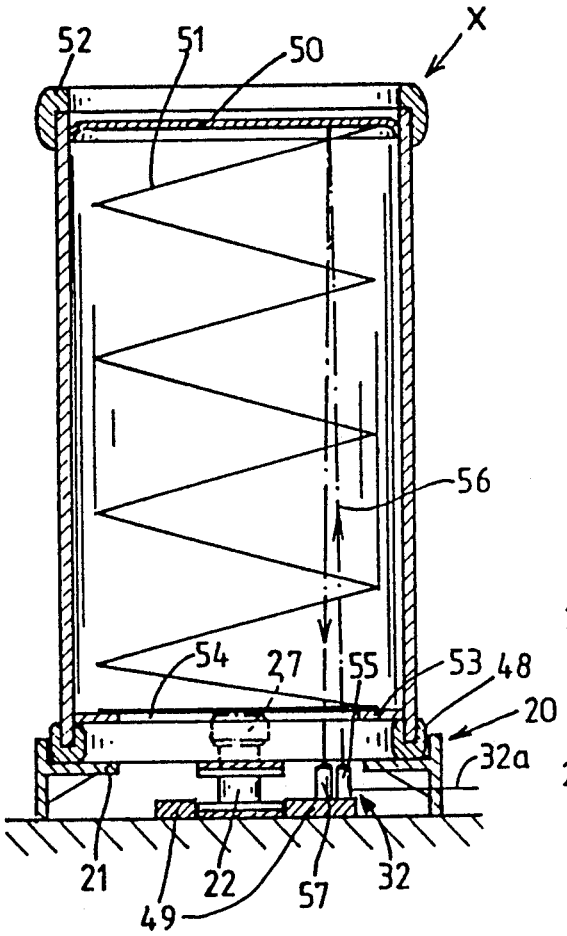
FIG. 3*a* is an enlarged front elevational view, in vertical section, of an empty sliver can being transported by the simultaneously advancing means shown in FIG. 2.
Figure 3B:
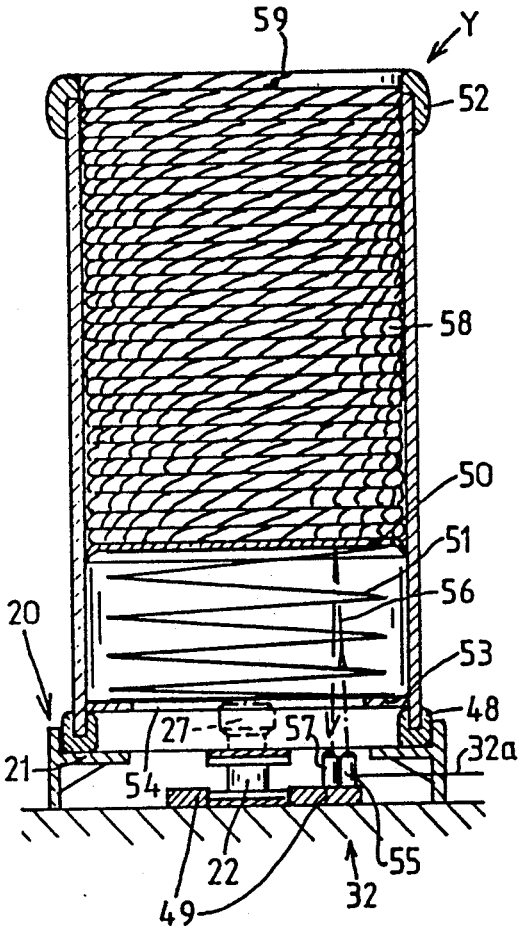
FIG. 3*b* is an enlarged front elevational view, in vertical section, of a full sliver can being advanced by the simultaneously advancing means shown in FIG. 2.

The can distribution apparatus 1 has a can return location at which cans are returned to the endless path from a spinning machine can delivery device or a can carriage 6 to the can distribution apparatus, and for transferring full cans to the can transport means. The can return location is, in the preferred embodiment, coincident with a spinning machine delivery location at which cans having sliver are distributed from the endless path to the can carriage 6. From there, the cans are transported by the closed loop transport assembly 20 over the guide track 21 to a means for distinguishing those cans suitable for handling at the particular can distribution location. For example, the can receipt location has a can fullness detector 32 for checking the fill ratio as seen in FIGS. 3*a* and 3*b* positioned upstream of the location. At a can receipt location or an empty can discharging station 33, the empty cans are taken down from the closed loop transport assembly 20 and delivered, via the empty can advancing device 15, to the line for filling with sliver. At a full can supply location or a full can delivery station 34, the cans freshly filled with sliver, brought from the can filling station 11 via the full can advancing device 19, are received by the closed loop transport assembly 20. At a full can preparation station 35, the sliver is positioned at the outer wall of the cans by means of a clamp, and the leading end of the sliver is cut to a predetermined length. The cans are also pre-oriented before transfer to the transport carriage such that, after the takeover by a can transport carriage at the station 31 for exchanging empty cans for filled cans, the cans are located on a can transport carriage in such a way that they are each deposited at the work stations of the textile machine in such a position as to enable an automatic apparatus to thread the sliver into the work station.

The presence of a sliver hanging over the edge of the can is detected by a means for ascertaining the readiness of cans on the endless path for transfer at the spinning machine delivery location in the form of a sensor 36. Those cans on which the sensor 30 is unable to detect a sliver hanging over the one edge cannot be prepared for a transfer to the can transport carriage. A turnstile 37 in the full can preparation station 35 cans enables accurate positioning of the cans at the devices for preparing and fastening the sliver.

The mode of operation of the can distribution apparatus is as follows. Once a can carriage 6 has exchanged sliver-filled cans for empty cans at the spinning stations of the spinning machine 3, it is moved over the rails 5 to the top end of the spinning machine and positions itself facing the can distribution apparatus 1 in the station 31 for exchanging empty cans for full cans.

The can carriage 6 has a turntable 7 with three can support positions A, B and C for cans, although the present invention contemplates that the can carriage can be configured as desired to carry a complement of greater or less than three sliver cans. The can carriage 6 has brought three empty sliver cans on these can support positions and has already transferred them to the closed loop transport assembly 20 of the can distribution apparatus 1. These are the three successive empty cans a, b and c. The can carriage 6 is ready for the takeover of three full cans. These three full cans d, e and f are located one after another on the closed loop transport assembly 20. The sliver can d has already been prepared and is located facing the can support position B on the turntable 7 of the can carriage 6 at the station 31 for exchanging empty cans for full cans. For takeover of the full cans, the can carriage 6 is equipped with a conventional manipulator for loading and unloading of cans, such as a manipulator of the type illustrated in German patent document DEOS 38 31 638.

The can e is still located in the full can preparation station 35. The sensor 36 is positioned to detect the leading end of the sliver at this can, so that this end can be fastened in the clamp on the wall of the can. The can f is located in front of the preparation station 35 and has yet to pass through it.

The individual operations of the can distribution apparatus 1 and the sliver loading assembly 2, and of the can distribution apparatus 1 and the spinning machine 3, are coordinated with one another in such a way that a can change is possible at the can changing station 31 on the can carriage 6 at any time, independently of the discharging of empty cans at the empty can discharging station 33 and delivery of full cans to the closed loop transport assembly 20 at the full can delivery station 34. A means for determining the location of those cans which have been distinguished by one of the distinguishing means on the endless path in the form of a controller 38 on the can distribution apparatus 1 is therefore provided, which via the signal line 39*a* communicates with the controller 39 of the spinning machine 3 and via the signal line 40*a* communicates with the controller 40 of the sliver loading assembly 2. For instance, if the can carriage 6 has been positioned at the station 31 for exchanging its empty cans for full cans, this positioning is reported to the controller 39 of the spinning machine, via the signal line 6*a*. However, a command to change a can cannot be issued to the station 31 until the positioning of the can carriage 6 has been reported to the controller 38 of the can distribution apparatus 1 via the signal line 39*a*. The controller 38 is operable to identify unoccupied can support positions on the endless path. For the transfer or receipt of a can, the closed loop transport assembly 20 must be at a standstill and the turnstile 37 must be in a position where reception or discharging of a can is possible. It must also be possible for an empty can at the station 31 to be deposited by the can carriage 6 onto an empty can support position on the closed loop transport assembly 20.

The nature of the can changing operation depends on whether the can carriage 6 is capable of immediately receiving a full can on an empty can support position on its turntable 7, or whether it has to wait until the closed loop transport assembly 20 has an empty can support position facing it, onto which it can then deposit an empty can. The occupancy status of the space at the station 31 is detected via a sensor 41 and reported to the controller 38 via the signal line 41*a*. If the space is empty, then the can carriage 6 can transfer its first empty can to the closed loop transport assembly 20. After that, it must wait until as the closed loop transport assembly 20 has been indexed by one can spacing. The rate for indexing can be pre-selected and may depend, for example, on the longest operating time required at a station for preparing or manipulating a can. Once this time has elapsed, the drive motor 24 of the closed loop transport assembly 20 receives the command from the controller 38, over the signal sliver loading assembly 24*a*, to move the chain 22 onward in the direction of the arrow 25 by a defined distance of at least one can diameter. The cans or empty can support positions thus change places at each station.

In the operational time period illustrated in FIG. 1, four incrementing steps have already been conducted after the transfer of the empty can a to the closed loop transport assembly 20, so that the full can d is located facing the can support position B on the turntable 7 of the can carriage 6. After the receipt of the full can, the turntable 7 is incrementally rotated by one can spacing, and an incremental advancing movement of the chain 22 of the closed loop transport assembly 20 is also performed. The turnstile 37 is incrementally rotated by one can spacing, via the signal line 3*a*. Once the full cans d, e and f have been discharged to the can support positions B, C and A, the can carriage 6 leaves the station 31 to travel to and service the work stations of the spinning machine 3.

As can be seen from FIG. 1, the closed loop transport assembly 20 is occupied by cans having different degrees of sliver fullness or fill ratios. This is schematically represented by the different shadings of the cans. As seen in the transport direction 25, the empty cans a, b and c follow by a partially filled can g. Such a can contains some residue of sliver that can still be spun at the spinning machine. However, an operational event such as a break of the sliver has caused its end to drop into the can, so automatic threading of the sliver into the work station of the spinning machine is no longer possible. The can g is deemed to be an "empty can" and is received by the can carriage 6 and exchanged for a sliver-filled can at the can changing station 31. The can g is now located on the closed loop transport assembly 20. At the can fullness detector 32 for checking the fill ratio of the can, the can g is recognized as a can having a reusable sliver residue—i.e., as a can having a sufficient remaining quantity of sliver to justify recirculating the can to the spinning machine 3.

An empty can support position h is located in front of the partially filled can g. Neither an empty can nor a sliver-filled can is located at that space. Can i is likewise only partially filled, as can be seen from the shading. Can k is a full can, but the sliver is not detectable to the sensor 36, so that the can cannot be prepared for transfer to the can carriage 6. Cans l, m and n are empty cans. At the can fullness detector 32, the fill ratio of the can m is just now being checked. Can n has already been recognized as an empty can. At the empty can discharging station 33, the empty can n is ready to be taken over by the empty can advancing device 15 for transport to the sliver loading assembly 2.

If the can fullness detector 32 ascertains an empty can, this is reported to the controller 38 via the signal line 32*a*. After the next incremental onward motion of the chain 22 in the transport direction 25, the drive 42 of the empty can advancing device 15 is thereupon switched on, via the signal line 42*a*. The empty can advancing device 15 then pulls the empty can, located at the empty can discharging station 33, to the position u. From the position u, the empty can is indexed by at least one empty can width at a time in the direction of the arrow 43 each time the full can advancing device 19 receives an empty can from the closed loop transport assembly 20, until the empty can reaches the waiting position 16.

Since the transfer station 33 for empty cans and the delivery station 34 for full cans are operatively connected with one another via the closed loop transport assembly 20, a closed loop transport of cans is possible. The operation of the empty can advancing device 15 for transporting the empty cans in the direction of the sliver loading assembly 2 and the full can advancing device 19 for transporting the full cans to the can distribution apparatus are controlled in such a way that a discharging of full cans can occur only after a prior discharging of empty cans. It is only after an empty can has been taken over by the empty can advancing device 15 to the position u that the drive 44 of the full can advancing device 19 can be turned on by the controller 38 and a full can, located in position v, can be transferred in the direction of the arrow 45 to the closed loop transport assembly 20, at the full can delivery station 34.

In the present exemplary embodiment, a full can o has already been transferred to the closed loop transport assembly 20. A further full can p stands in front of this full can. The can q has been identified as a partially filled can by the can fullness detector 32.

The fill ratios of the cans, identified by the can fullness detector 32, are reported via the signal line 32*a* to the controller 38, where they are displayed on a means operatively connected to the location determining means in the form of an indicator or display unit 46 in the applicable position of the cans for informing an operator about the sliver fullnes or readiness condition of cans on the endless path. Each time the chain 22 is indexed incrementally by one can support position, the information is carried over to the next can support position, so that the course of a can may be followed at any time on the indicator. The indicator 46 also shows whether the can support positions are occupied by full cans, empty cans, or partially filled cans, or are empty positions. If an empty can is taken over by the empty can advancing device 15 at the empty can discharging station 33, this creates an empty position on the closed loop transport assembly 20 onto which a full can may be placed at the full can delivery station 34. The delivery of a full can to the closed loop transport assembly 20 is recorded by the controller 38 and displayed on the indicator 46.

If partially filled cans are recognized at the can fullness detector 32—in other words, cans with a usable sliver residue and full cans that are not preparable—then these cans are transported to the full can delivery station 34 via the empty can discharging station 33. If the closed loop transport assembly 20 is occupied by partially filled cans and nonpreparable full cans, a transfer of full cans is prevented. The partially filled cans and the nonpreparable full cans circulate on the closed loop transport assembly 20 until the number of such cans equals or exceeds a limit value previously inputted into the controller 38 by a limit value transducer 38'. This limit value is also displayed on the indicator 46. A signal is also tripped, and the closed loop transport assembly 20 is stopped. Since neither the partially filled cans nor the nonpreparable full cans can be prepared at the preparation station 35, an operator is called via an alarm signal of an alarm device 38" and the operator then manually takes the leading end of the sliver out of the applicable can and hangs it over the edge of the can such that the sensor 36 can detect a sliver hanging out of the can.

Each can transfer at the station 31 involving the transfer of a full can to the can carriage 6 and the transfer of an empty can to the closed loop transport assembly 20 is recorded by the controller 38 as an exchange of a full can for an empty can and is displayed on the indicator 46. However, if more full cans are discharged to the can carriage 6 than empty cans are discharged from that carriage to the closed loop transport assembly, a correspondingly high number of empty can support positions will remain on the closed loop transport assembly 20, and these empty can support positions are detected by the sensor 41 and displayed on the indicator 46. Cans still in circulation can continue to be detected and monitored, and their status remains identifiable as such on the indicator 46. The cans taken over from the can carriage 6 at the station 31 by the closed loop transport assembly 20 are initially recognized as empty cans and it is not until the can fullness detector 32 can detect the fill ratio of the taken over cans that a subsequent determination of the number of empty cans and partially filled cans be made. The partially filled cans are recognized by the can fullness detector 32 and are stored in memory by the controller 38. After each storage in memory of a further partially filled can, the total number of the detected partially full cans is compared with the limit value and an alarm is tripped if the limit value is equaled or exceeded, and the closed loop transport assembly 20 is stopped.

FIGS. 3*a* and 3*b* show the checking of the fill ratio of cans. In FIG. 3*a*, a can x is located on the closed loop transport assembly 20. The can bottom 48 rests on the guide track 21, and the driver 27 presses against the edge of the can bottom of the can x moved in the direction toward the observer. At the location of the can fullness detector 32, the guide track 21 is open far enough that the chain 22 is guided not in a groove but rather between two track boundaries 49.

Can x is an empty can, since a movable can bottom 50 is pressed by the spring 51 as far as the upper can edge 52, and no sliver residues rest on the bottom. The spring 51 is supported on an annular bottom 53 on the can base. The underside of the can bottom 50 is scanned by the can fullness detector 32 through the opening 54. The can fullness detector 32 is preferably a distance measuring instrument that measures ultrasound. An ultrasound signal 56 is transmitted by a transmitter 55, reflected at the can bottom 50, and received as a radar echo by the antenna 57. The fill ratio of the can containing sliver can be determined on the basis of different radar echoes at different positions of the can bottom 50. Beyond a certain distance between the can bottom 50 and the antenna 57 downward, it can be assumed that a usable residue of sliver is still located in the can.

The detection of a can with a usable residue can be seen from FIG. 3*b*. It shows a can y, which is filled with sliver 58. The end 59 of the sliver is located inside the can, where it can no longer be grasped by an apparatus for automatically threading the sliver at the work station of a textile machine.

Since the ultrasound signal 56 emitted to evaluate the can shown in FIG. 3*b* travels a substantially shorter distance than that in the exemplary embodiment of FIG. 3*a*, a radar echo that differs from that received from the can shown in FIG. 3*a* is produced at the antenna 57, so the conclusion may be drawn that a sliver-filled can whose sliver residue is still usable exists. Checking the fill ratio of the cans can also be done in other ways. For instance, sensors which emit light beams reflected at a predetermined position of the can bottom can also be used. Alternatively, weight measurements can provide information on the fill ratio of the cans.

The fill ratio ascertained is transmitted via the signal line 32*a* to the controller 38, which thereupon either discharges the can as an empty can at the discharging station for empty cans, or leaves it in circulation as a partially filled can.

Figure 4A:
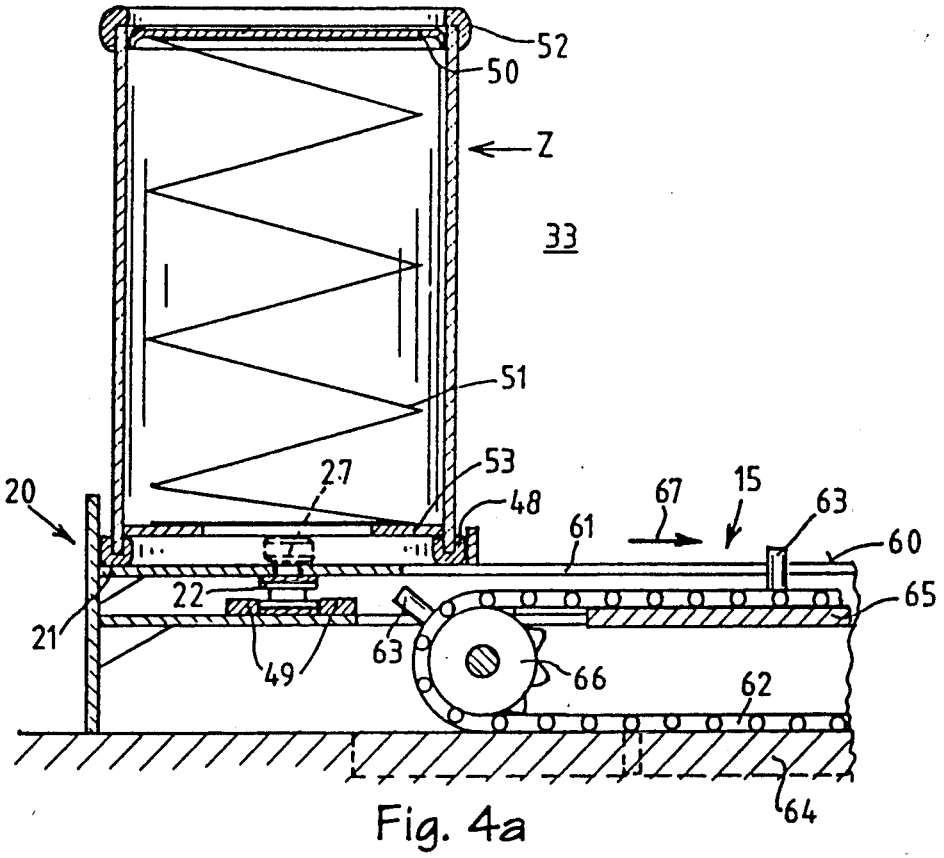
FIG. 4*a* is an enlarged side elevational view, in partial vertical section, of the can preparation advancing means associated with the sliver can distribution apparatus shown in FIG. 1, taken along line A—A in FIG. 4*b;*
Figure 4B:
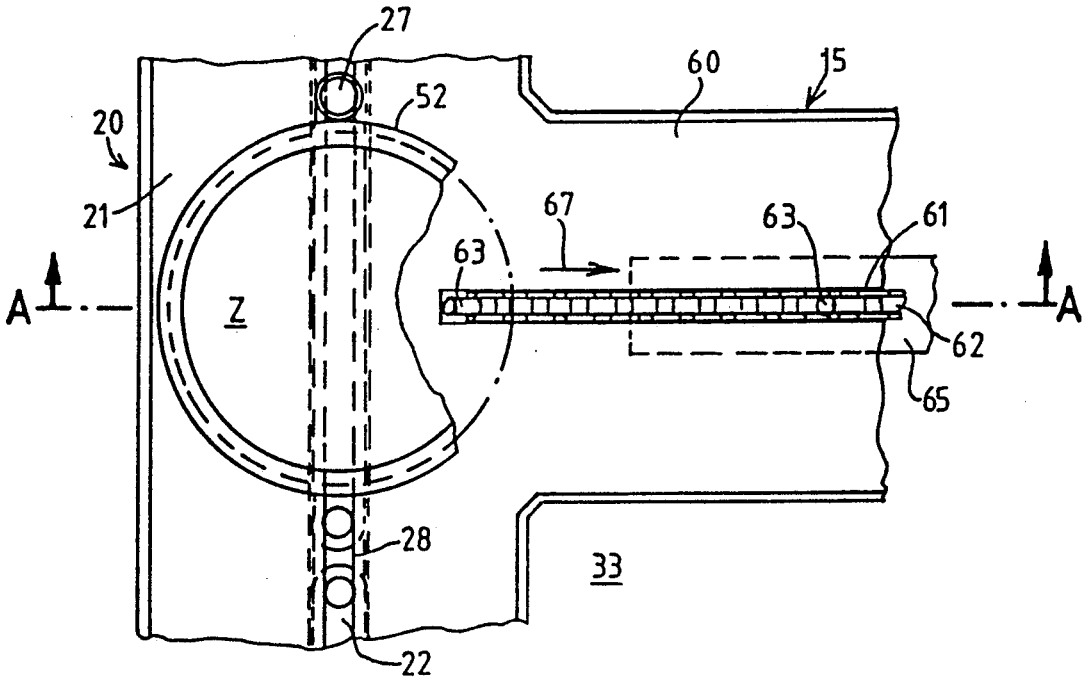
FIG. 4*b* is an enlarged top plan view, in partial horizontal section, of a portion of the can preparation advancing means shown in FIG. 4*a;*

FIGS. 4*a* and 4*b* show an exemplary embodiment for the empty can discharging station 33.

An empty can z is located on the guide track 21 of the closed loop transport assembly 20. Characteristics that match the empty can x of FIG. 3*a* are identified by the same reference numerals. From the closed loop transport assembly 20, the empty can advancing device 15 extends at a right angle for removing the discharged empty cans. The empty can z has been pushed precisely into a position in front of the empty can advancing device 15 by means of the driver 27. The empty can advancing device 15 comprises a guide track 60, which has a central guide slit 61. A transport chain 62 revolves below the guide track. The transport chain 62 has drivers 63 at fixed intervals of at least one can diameter. These drivers 63 protrude from the guide slit 61 to engage a can under the bottom edge 48 thereof and pull the can with the chain 62. The chain is held on its track by its guide slit 61 in the guide tracks 60 and by a slit 64 in the bottom, due to the vertical plane of revolution of the chain.

A support plate 65 for supporting the chain is provided below the guide track 60. It prevents the chain from sagging. At the transfer station 33, the chain is trained around a gear wheel 66 which is connected to a conventional drive means (not shown). The upper run of the chain moves in the direction of the arrow 67 away from the closed loop transport assembly 20. The gear wheel 66 is disposed below the discharging station in such a way that a driver 63 extends through the guide slit 61 to grip the bottom edge 48 of a can from underneath and thus pull the empty can z onto the empty can advancing device 15.

The empty can advancing device 15 can be turned on only if the chain 22 of the closed loop transport assembly 20 is at a standstill and a can is in position. The controller 38 controls the empty can advancing device 15 and the closed loop transport assembly 20 in such a way that a can is always positioned in front of the entry to the empty can advancing device 15. During can transport, the chain 62 must always be located such that no driver 63 protrudes out of the guide slit at the discharging station. The empty can advancing device 15 is not activated until an empty can to be transferred has come to a standstill, and only then does a driver 63 of the transport chain 62 pull the can, by its bottom edge 48, from the closed loop transport assembly 20 into the empty can advancing device 15 toward the sliver loading assembly 2 in the direction of the arrow 67.

The present invention also contemplates that other devices for discharging an empty can to a closed loop transport assembly toward the sliver loading assembly 2 can be used. Instead of a chain with drivers, for instance, an inclined roller track may be provided, with a manipulator that pushes the cans downward from the guide track 21. The diversion of cans to the empty can advancing device 15 can also be accomplished by means of a shunt that is pivoted into the transport path.

The structure of the full can advancing device 19 is essentially the same as the empty can advancing device 15. In the delivery of the cans, care must be taken to assure that the drivers, as in the case of the closed loop transport assembly 20, press from outside against the bottom edge of a can and thus act upon the cans so as to push them. To prevent the drivers from getting in the way of the cans on the closed loop transport assembly 20, the gear wheel 66 is disposed in such a way that the drivers have already dropped into their guide slit upon approach to the closed loop transport assembly 22.

Figure 5A:
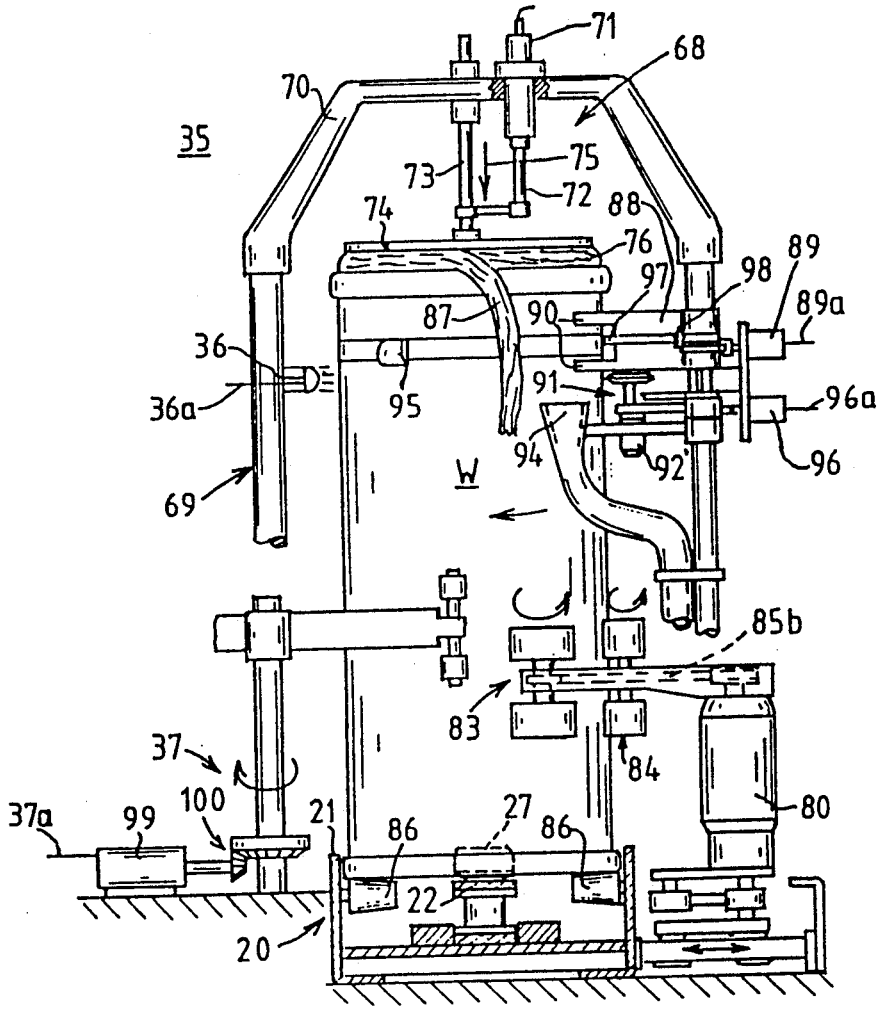
FIG. 5*a* is an enlarged front elevational view, in partial vertical section, of a sliver end preparation device of the sliver can distribution apparatus shown in FIG. 1.
Figure 5B:
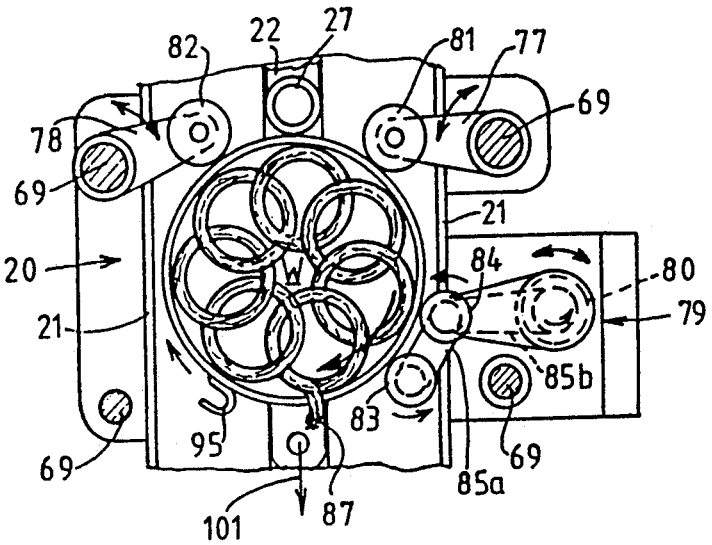
FIG. 5*b* is a top plan view of the sliver can centering components of the sliver edge preparation device shown in FIG. 5*a;*

FIGS. 5*a* and 5*b* show the devices at the preparation station 35 for preparing the leading end of the sliver and orienting the cans.

The preparation station 35 has a compressor 68. A full can w is positioned under a stand 69. A pneumatic cylinder 71 is secured to an arch 70 of the stand 69. The piston 72 of the cylinder is connected to a rod 73 that is guided vertically through the arch. The rod has a plate 74 at its lower end. This plate is just large enough to fit into the opening of a can. The compressor 68 is disposed such that, after centering of the can below the compressor 68, the plate can be lowered until it is inside the can.

Cans coming from the sliver loading assembly 2 are filled with sliver and may have multiple layers of sliver that protrude out over the upper edge of the can. These layers of sliver can hinder the manipulation of the cans in automatic can changing. For this reason it is advantageous if the protruding layers of sliver are stuffed into the can. To that end, a compressor 68 is disposed at the full can preparation station 35. Once a full can is positioned under a stand 69 at the preparation station 35, a pneumatic cylinder 71 is actuated to drive a plate 74 downward in the direction of the arrow 75. The plate 74 presses against the protruding layers 76 of sliver and tamps it into the can. The plate 74 is sufficiently lowered to preclude overflow past the upper can edge. The pneumatic cylinder 71 is subsequently actuated once again and the plate 74 is returned to the outset position.

The preparation of the full cans also includes the fixing of the leading end of the sliver at the can edge and the positioning of the cans in a position such that they can be set down in front of the work stations of a textile machine, for automatic threading of the sliver into these stations. As seen in FIGS. 5*a* and 5*b*, the full can w transported along the closed loop transport assembly 20, is positioned in such a way, with the aid of the turnstile 37 and two pivotable centering aids 77 and 78 mounted laterally of the closed loop transport assembly 20, that it is ready for the loading of sliver therein and for the positioning of the leading end of the sliver to the can edge.

A centering device 79 is pivoted against the can by means of a motor 80 for positioning the sliver end and orienting the can. Via a lever system, not shown here, the centering aids 77 and 78 are connected to the centering device 79, so that once the centering device 79 is moved adjacent the can, they are likewise applied to the outer wall of the can w with their respective rollers 81 and 82. The centering device 79 has two drivable pairs of rollers 83 and 84, which contact the outer wall of the can w. The pairs of rollers are connected with one another via a belt 85*a* and with the motor 80 via a belt 85*b*. The two pairs of rollers are driven in the direction of the arrows shown in FIG. 5*b*, so the can w rotates clockwise. To facilitate the rotation of the can w, the can in the preparation station 35 rests on rollers 86, which at this point form part of the guide track.

Figure 6A:
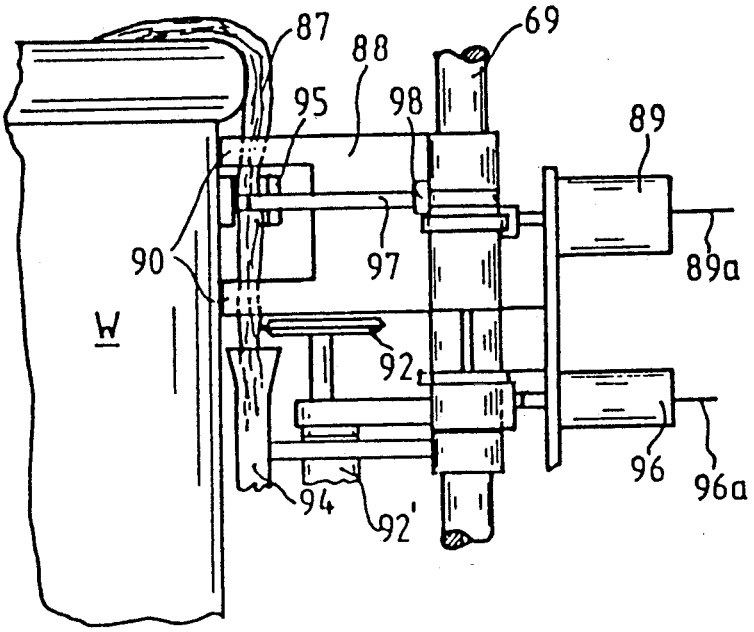
FIG. 6*a* is an enlarged front elevational view of a portion of the sliver edge preparation device shown in FIG. 5*a;*
Figure 6B:
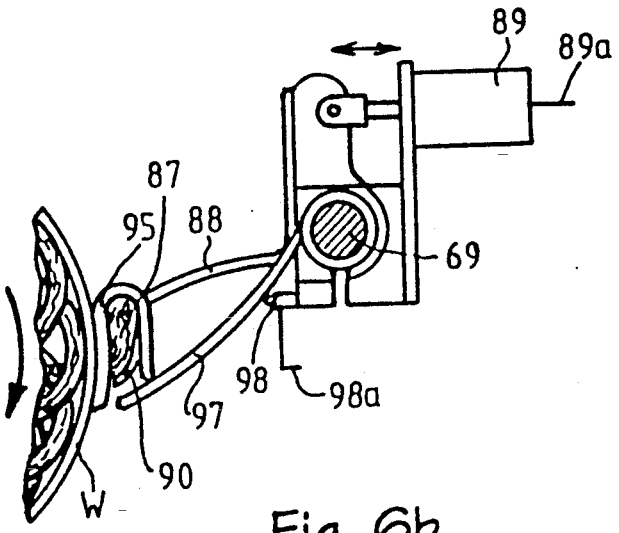
FIG. 6*b* is a top plan view of the portion of the sliver edge preparation device shown in FIG. 6*a;*
Figure 6C:
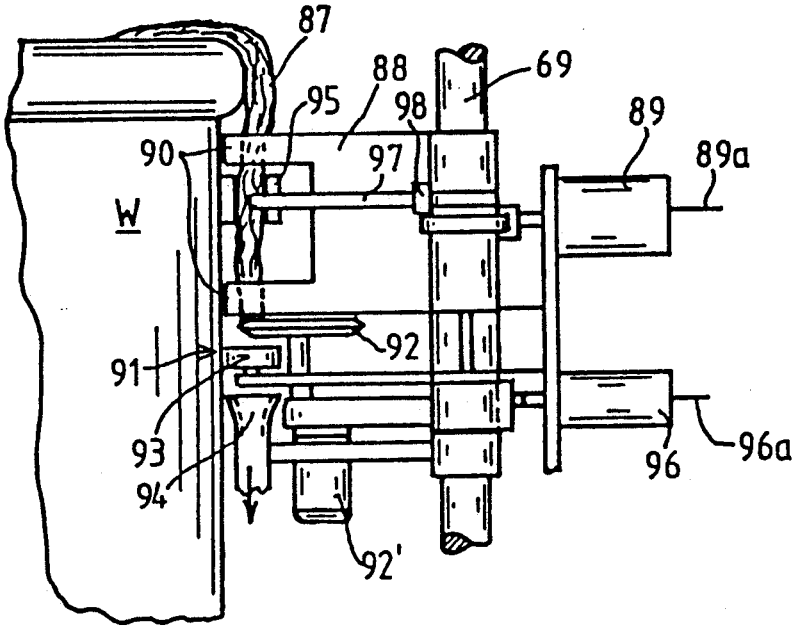
FIG. 6*c* is an enlarged front elevational view of the portion of the sliver edge preparation device shown in FIG. 6*a* and showing the device at the time of severing of a sliver end.

In the case of the cans arriving from the full can delivery station 34, the leading end of the sliver 87 hangs downward over the can edge. If the centering device 89 rotates the can, the sliver 87 moves past the sensor 36 for detecting the sliver. If the sensor detects that a sufficient length of sliver is hanging over the edge of the can, an indexable holding down device 88 is actuated via the controller 38. An actuator 89, such as a solenoid, is actuated via a signal line 89*a* connected to the controller 38 and swivels the holding down device 88 toward the can in the direction of the arrow shown in FIG. 5*a*, around a column of the stand 69. The details are shown in FIGS. 6*a* and 6*b*. With its prongs 90, the holding down device 88 sweeps over the can wall and grasps the sliver 87. Simultaneously with the movement of the indexable holding down device 88, a cutting device 91 connected thereto is pivoted toward the can wall. The cutting device is disposed below the holding down device 88. The cutting device 91 comprises a driven severing disk 92, a support roller 93, and a suction tube 94 for removing the cut-off sliver residues by suction, as seen in FIGS. 6*c* and 6*d*.

When the holding down device 88 sweeps with its prongs 90 along the wall of the can w, these prongs grasp the dangling sliver 87 (which is prevented from moving along with the rotating can), and hold it firmly in the region of the can wall. As the clamp 95, which is open in the direction of rotation, moves past the sliver 87, the sliver 87 slides into it and is retained by the clamp. In correspondence with the receipt of the sliver 87, the clamp 95 actuates a switching lug 97, which in turn actuates a contact 98, which stops the motor 80*a* of the centering device 79 via a signal line 98*a*. An actuator 96 swivels the cutting device 91 toward the can w, whereupon a motor 92' of the severing disk is turned on.

Figure 6D:
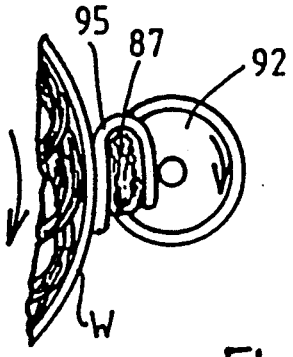
FIG. 6*d* is a top plan view of the portion of the sliver edge preparation device shown in FIG. 6*c;*

As can be seen in FIG. 6*d*, the severing disk 92 severs the sliver 87 at a predetermined distance from the clamp 95. The cut end of the sliver is removed by suction through the suction tube 94. The sliver has now been cut below the clamp 95 to a defined length that can be grasped by an automatic threading device at the work stations of a textile machine. The holding down device 88 and the cutting device 91 may be disposed such that, once the sliver has been fixed in the clamp, the can is already located in the correct transfer position. Alternatively, a further sensor for sensing the position of the clamp may be provided. After the preparation of the leading end of the sliver, the can is then rotated until the further sensor senses the clamp and the sensing is evaluated as an indication that the can is then correctly positioned for automatic manipulation of the sliver.

Once the sliver has been placed in the clamp and shortened to the predetermined length, signals are issued to the actuators 89 and 96 via the controller 38 to effect movement of the holding down device 88 and the cutting device 91 back into their respective initial positions. At the same time, the centering device 79 is pivoted back into its initial position, so that the centering aids 77 and 78 move outward from the can and likewise pivot back to their initial positions, thereby releasing the guide track 21 of the closed loop transport assembly 20 again. Via the signal line 37*a*, the drive 99 of the turnstile 37 is actuated and rotated clockwise via a gear 100. At the same time, the closed loop transport assembly 20 is also activated. Instead of being driven separately via a motor, the turnstile 37 may also be coupled to the closed loop transport assembly 20 for movement in correspondence with movement of the closed loop transport assembly 20. For example, the turnstile 37 could be coupled with the closed loop transport assembly 20 via a gear wheel that meshes with the chain 22.

After its release, the can w is transported in the transport direction 101, as shown by the arrow in Fib. 5*b*, to the station 31 for exchanging the empty cans for full cans.

Figure 7:
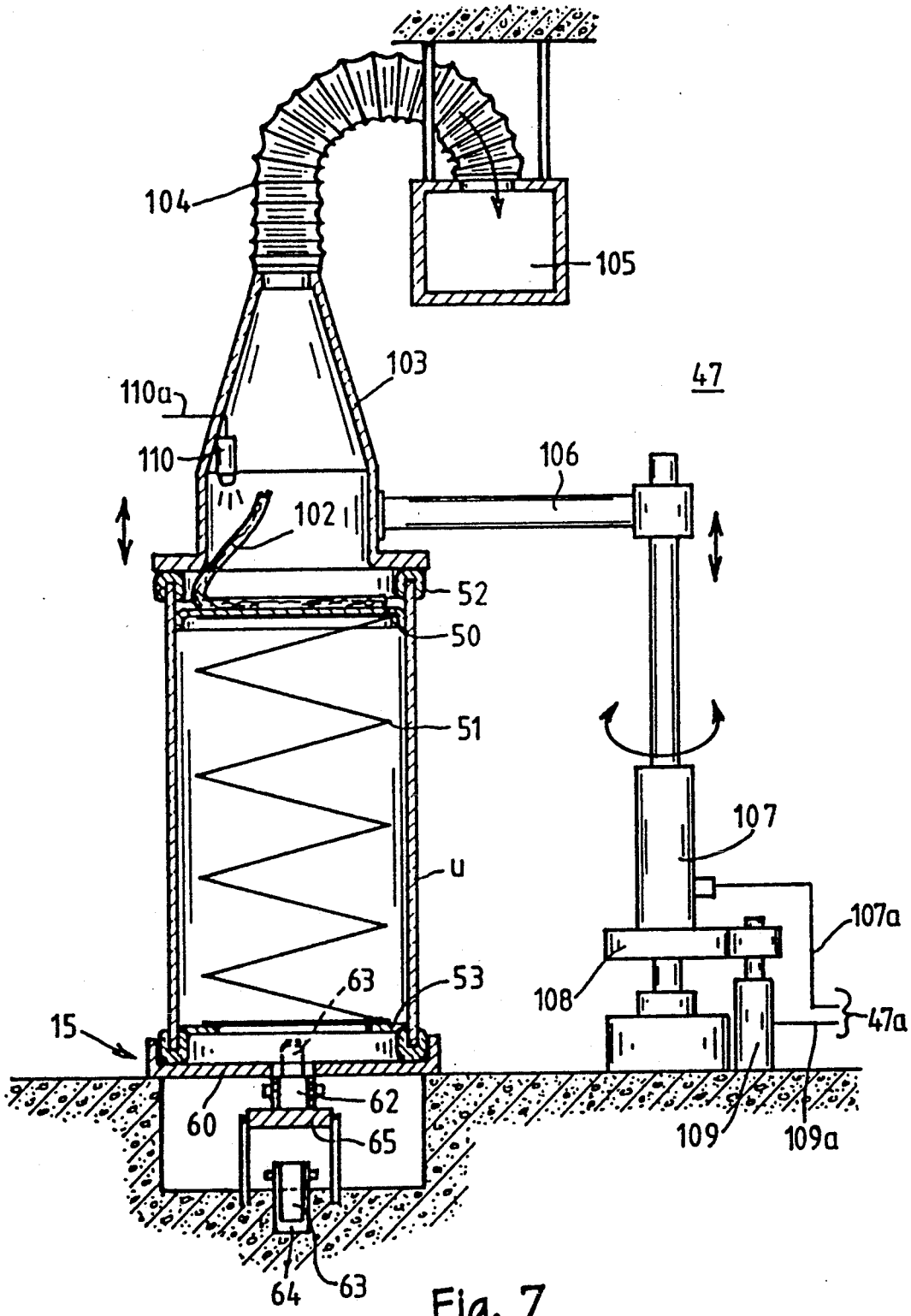
FIG. 7 is an enlarged front elevational view, in partial vertical section, of a sliver removing device of the sliver can distribution apparatus shown in FIG. 1.

A means for selectively removing sliver from cans in the form of a cleaner 47 is provided to empty the cans of any sliver residues at the empty can advancing device 15 downstream of the empty can discharging station 33 as viewed in the transport direction 43. As seen in FIG. 7, if an empty can is in the position u on the empty can advancing device 15, the cleaner 47 is actuated via a signal line 47*a* connected to the controller 38, and the empty can is cleaned of sliver residues that can no longer be used in the spinning machine.

Empty cans that are retrieved by the can carriage 66, for example from a spinning machine, may contain sliver residues which result from the finish of a batch or after a certain number of bobbins have been processed. These sliver residues, which are no longer of such a quantity as to be usable, must be removed from the cans before the cans are returned to the line for being filled again. This removal takes place at the empty can advancing device 15. For example, an empty can located in the position u at the cleaner 47 has a sliver residue 102. If a sliver residue 102 of this kind is detected at the cleaner by a sensor 110, the cleaner 47 is positioned either manually or automatically. Preferably, the cleaner 47 includes a suction bell 103, which is connected via a flexible hose 104 with a collection line 105 for removing the sliver residues to a central collection location (not shown).

The suction bell 103 is secured via a swivel arm 106 to a lifting cylinder 107. This lifting cylinder is supported for rotation about its axis and can be swiveled by a motor 109 via a gear 108. Although not shown, in its initial position, the suction bell 103 rests on a plate that closes the opening of the suction bell. As a result, unnecessary consumption of energy to maintain a vacuum is prevented.

If an empty can is in position u and if a sliver residue 102 has been detected at the can fullness detector 32, the lifting cylinder 107 is first actuated by the controller 38 via the signal 107*a*, and the suction bell 103*a* is raised. The motor 109 is then actuated, and, via the gear 108, the lifting cylinder 107 is swiveled sufficiently to position the suction bell 103 at the position u above the can. The lifting cylinder 107 is then driven downwardly to seat the suction bell 103 with its opening on the edge 52 of the can. Since a negative pressure already prevails in the suction bell 103, the sliver residue 102 is aspirated directly and removed, as can be seen from FIG. 7. The action of the removal of the sliver residues by suction can be monitored via a sensor 110. This sensor 110 may be built into the wall of the suction bell 103 and can monitor the bottom 50 of the can. The conclusion of the can cleaning is reported to the controller 38 via a signal line 110*a*. The controller 38, via the signal lines 47*a*, causes the lifting cylinder 107 to move upward and controls the suction bell to swivel into its initial position and to subsequently lower onto the plate that closes it. The can is now cleaned in the position u for filling with new sliver and can be transported to the line by the empty can advancing device 15.

The removal of sliver residues can also be done with other devices. For instance, mechanical grippers may be provided to lift the sliver residues out. The sliver residues may also be deposited on a belt provided with recesses for receiving the removed sliver residue that delivers the residues to a collecting point. If it is not possible to provide a collection assembly 105 for removal of the sliver residues, then locally disposed cleaners such as vacuum cleaners that collect the sliver residues in a storage container may be provided.

Figure 8:
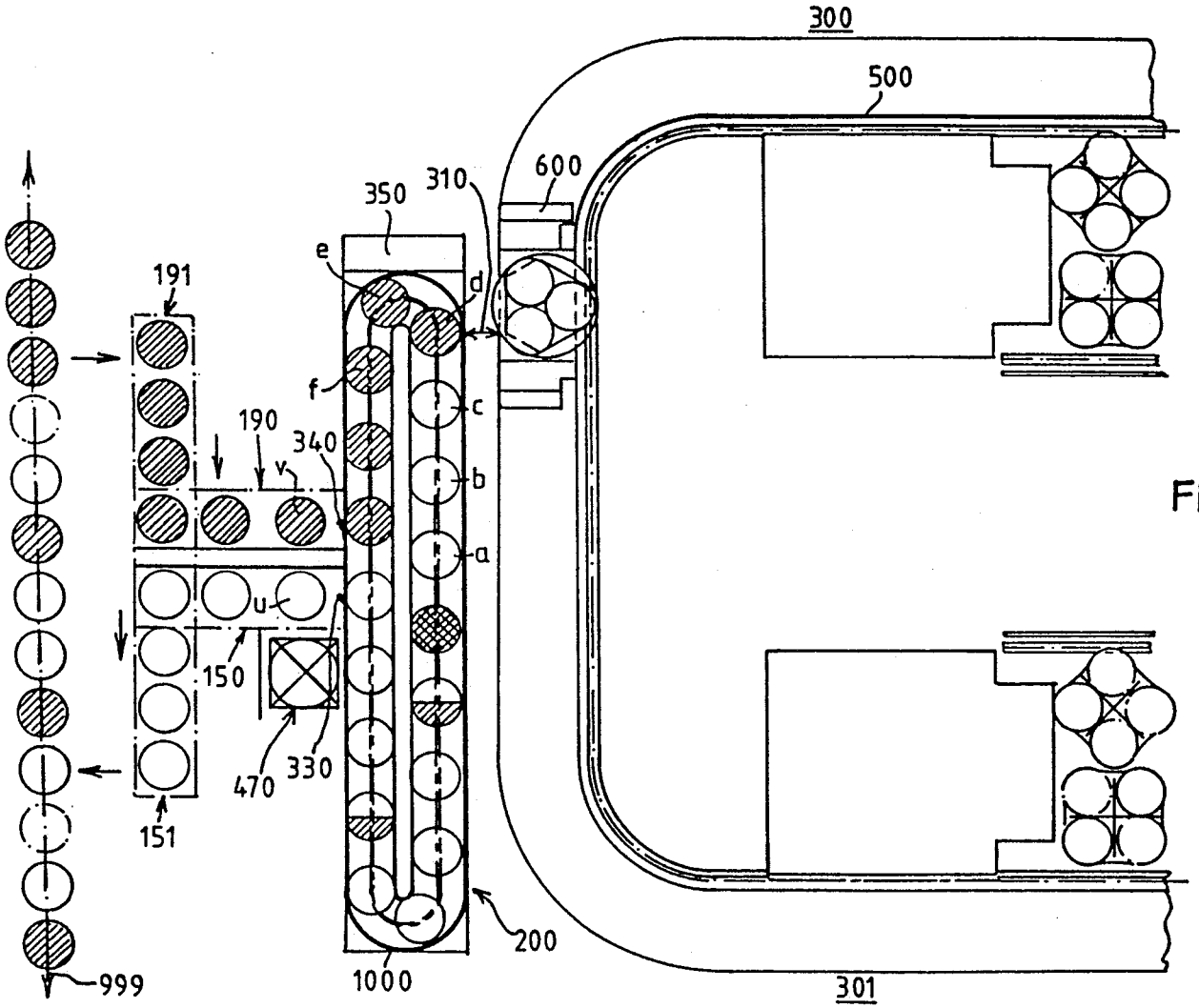
FIG. 8 is a schematic top plan view of a variation of the sliver can distribution apparatus of the present invention.

FIG. 8 illustrates a modification of the can distribution apparatus in which the can distribution apparatus is located between a plurality of spinning machines that are to be provided with cans and a temporary can storage assembly that is served by a closed loop transport assembly 1000. This closed loop transport assembly serves a plurality of such temporary can storage assemblies as needed.

Two spinning machines 300 and 301 are supplied with fresh full sliver cans and have empty cans removed by one can carriage 600. The can carriage 600 travels around both spinning machines on a rail 500. The can distribution apparatus 1000 has a station 310 for exchanging empty cans that the can carriage 600 has removed from the spinning machines for full cans. The station 310 is located downstream of the preparation station 350 for full cans.

At a discharging station 330, empty cans are fed to a empty can advancing device 150, and are cleaned of sliver residues at a cleaner 470 and then further transported to a temporary store 151, which transfers its empty cans, as symbolized by the arrow, to a multi machine can transport line 999. Although not shown in detail here, this multi machine can transport line 999 communicates with other sliver can transport assemblies and exchanges empty cans for full cans there upon request. The closed loop transport assembly 999 may change its transport direction if needed, in order to enable optimal can changing.

A full can advancing device 190, which is connected to a temporary storage assembly 191 and takes full cans from it, as represented by the arrow, opens into a full can delivery station 340. The temporary storage assembly 191 takes over individual full cans or groups of cans as needed from the closed loop transport assembly 999, as symbolized by the arrow in FIG. 8.

A can distribution apparatus such as the one shown in FIG. 8 which is preceded by temporary stores is capable of simultaneously furnishing cans individually to a plurality of textile machines that process sliver and removing cans from them. Priority circuits may be provided and not only for the last exemplary embodiment described. As needed and to avoid backups, it is, for instance, possible for empty cans to be primarily removed from the textile machines via the can transport carriages to the can distribution apparatus, which in turn then gives priority to discharging empty cans either to a line or to a can closed loop transport assembly. If there is a greater need for full cans, for instance, after a batch change, then the can distribution apparatus can give priority to discharging full cans to the can transport carriage.

The transport of partially filled cans and nonpreparable full cans within the can distribution apparatus may lead to an increased strain on the can transport system, especially when a plurality of spinning machines are served, because these cans are carried along unprepared in the circulation for a certain period of time. It is therefore conceivable to provide a further discharging station for moving partially filled cans and nonpreparable full cans to a waiting position. This may involve a parking position for a plurality of cans, which are removed there by means of a suitable transport system and which wait there for manual preparation by an operator. If the parking positions are filled, an alarm can be sent which prevents the further delivery of partially filled cans and nonpreparable full cans. After preparation of the cans in the parking position, these cans can be fed back into the can distribution apparatus; each feeding is recorded by the controller to prevent the delivery of full cans. The manually prepared cans must be fed in before the full can delivery station. The delivery may be done manually or automatically; each time a manual delivery to an empty can support position in the closed loop transport assembly occurs, the delivery of a filled can may be reported to the controller by means of a reporting display. The report may also be initiated by running over a sensor.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A sliver can distribution apparatus for distributing cans of the type which carry sliver to be withdrawn for processing at a textile machine comprising:

means for conveying sliver cans in an endless path interconnecting a plurality of can distribution locations, the can distribution locations including a can transfer location at a textile machine at which cans having sliver prepared for automatic engagement of the sliver by a textile machine are distributed from the endless path to a textile machine and cans are returned to the endless path from the textile machine, a full can supply location at which cans with full loads of sliver are supplied to the endless path, and a can receipt location at which cans having less than a usable load of sliver are received from the endless path for subsequent filling of the cans with sliver;

said conveying means simultaneously advancing along the endless path cans of varying degrees of sliver fullness and varying degrees of readiness independent of whether a can is an empty can, a can having less than a usable load of sliver, a can having a usable partial load of sliver but not prepared for automatic engagement of the sliver by a textile machine, a can having a full load of sliver but not prepared for automatic engagement of the sliver by a textile machine, or a can having a full or usable partial load of sliver prepared for automatic engagement of the sliver by a textile machine;

means for sensing the condition of the sliver in the cans; and control means responsive to said sensing means to control transfer of cans at at least one of said can distribution locations depending on the sensed condition of sliver in the cans.

2. A sliver can distributing apparatus according to claim 1 and characterized further in that said means for sensing the condition of sliver in the cans senses whether a can in the endless path at the can transfer location to the textile machine has a full or a usable partial load of sliver prepared for automatic engagement of the sliver by a textile machine, and said control means controls transfer to the textile machine of cans having a full or usable partial load of sliver prepared for automatic engagement of the sliver by a textile machine.

3. A sliver can distributing apparatus according to claim 1 wherein said means for sensing the condition of sliver in the cans senses whether a can at the can receipt location has less than a usable partial load of sliver therein, and said control means is responsive to said sensing means to control transfer from the endless path at the can receipt location of cans having less than a usable partial load of sliver therein.

4. A sliver can distributing apparatus according to claim 1 and further comprising means for determining the location of cans sensed by said sensing means, and means for transferring such cans in correspondence with the positioning of such cans at the at least one can distribution location.

5. A sliver can distributing apparatus according to claim 4 and further comprising means operatively connected to the location determining means for informing an operator about the sliver condition of cans on the endless path.

6. A sliver can distributing apparatus according to claim 5 wherein the conveying means includes a plurality of can support positions which are simultaneously advanced along the endless path, each can support position for supporting a can, and means for identifying the unoccupied can support positions of the endless path, and the operator informing means is operatively connected to the unoccupied can support position identifying means for informing an operator of unoccupied can support locations.

7. A sliver can distributing apparatus according to claim 6 and further comprising can reload means operatively connected to the can receipt location for reloading cans received thereat with loads of sliver and operatively connected to the full can supply location for supplying reloaded cans having full loads of sliver to the endless path and means for controlling the supply of reloaded cans to the endless path such that, if the can support positions of the endless path are fully occupied, a reloaded can is only supplied to the endless path at the full can supply location if a can to be reloaded has been received from the endless path at the can receipt location.

8. A sliver can distributing apparatus according to claim 4 wherein the sensing means includes means for counting the number of cans having that do not have a full or usable partial load of sliver prepared for automatic engagement of the sliver by a textile machine, and means operatively connected to the counting means for signaling that a predetermined number of cans have been counted.

9. A sliver can distributing apparatus according to claim 4 wherein the sensing means includes means for determining the sliver fullness of cans on the endless path, each can has a movable bottom which moves upwardly as sliver is drawn from the can and the sliver fullness determining means includes means for detecting the height of the bottom of a can.

10. A sliver can distributing apparatus according to claim 4 and further comprising means for positioning an end of sliver in a predetermined position relative to the can in which the sliver is coiled for automatic engagement of the positioned sliver end at a spinning machine and the sensing means includes means for ascertaining the readiness of a can for distribution at the textile machine delivery location based upon detection of the presence or absence of a sliver end in the predetermined position.

11. A sliver can distributing apparatus according to claim 4 wherein the conveying means includes means for incrementally moving the cans by a uniform distance increment at least as great as the width of a can in a cyclical manner in which the time between each cycle of incremental movement is set at the respective longest time for handling of a can at the can distribution locations.

12. A sliver can distributing apparatus according to claim 10 and further comprising a turnstile for advancing cans through the sliver end positioning means.

13. A sliver can distributing apparatus according to claim 1 and further comprising means for selectively removing sliver from cans transferred from the endless path to the can return location.

14. A sliver can distributing apparatus according to claim 13 wherein the selectively removing means includes a device for applying suction to the interior of a can to effect the suctioning of sliver out of the can.

15. A sliver can distributing apparatus according to claim 14 wherein the selectively removing means includes a collection device for collecting removed sliver.

16. A sliver can distributing apparatus according to claim 1 wherein at the can transfer location cans are distributed from the endless path to a textile machine can delivery device and cans are returned to the endless path from the textile machine can delivery device.

* * * * *